US005400710A

United States Patent [19]

Ehrhard

[11] Patent Number: 5,400,710

[45] Date of Patent: Mar. 28, 1995

[54] APPARATUS FOR EXCHANGING A DOCTOR BLADE IN A ROTARY PRINTING PRESS

[75] Inventor: Toni Ehrhard, Breuberg, Germany

[73] Assignee: MAN Roland Druckmaschinen AG, Germany

[21] Appl. No.: 263,794

[22] Filed: Jun. 22, 1994

[30] Foreign Application Priority Data

Jun. 23, 1993 [DE] Germany ..... 43 20 833.9

[51] Int. Cl.[6] ..... B41F 31/04

[52] U.S. Cl. ..... 101/363; 101/169

[58] Field of Search ..... 101/350, 363, 207–210, 101/148, 349, 365, 157, 169, 366; 118/261

[56] References Cited

U.S. PATENT DOCUMENTS 2,018,103 10/1935 Smith ..... 101/366
2,947,248 8/1960 Fuchs .
5,184,556 2/1993 Schaeuble .

FOREIGN PATENT DOCUMENTS 071180 7/1982 European Pat. Off. .
1761439 6/1971 Germany .
1806140 5/1974 Germany .
3823340C1 1/1990 Germany .
3832216C1 5/1990 Germany .
3909879C1 8/1990 Germany .
3838546C2 4/1993 Germany .
00017 2/1989 WIPO .

*Primary Examiner*—J. Reed Fisher
*Attorney, Agent, or Firm*—Leydig, Voit & Mayer, Ltd.

[57] ABSTRACT

A chamber-type doctor blade apparatus for exchanging or replacing a doctor blade in a running printing press is disclosed. The apparatus includes a housing defining an elongated opening for slidably receiving a receiver carrying a doctor blade. When inserted in the elongated opening, the receiver pivots a sealing doctor blade against its normal bias and out of engagement with an applicator roller of the printing press. When the receiver is removed from the elongated opening the sealing doctor blade pivots back into engagement with the applicator roller thereby preventing printing fluids from exiting the chamber-type doctor blade apparatus through the elongated opening when the receiver is removed. As a result, the doctor blades of the chamber-type doctor blade apparatus can be replaced while the serviced printing machine is running.

9 Claims, 2 Drawing Sheets

APPARATUS FOR EXCHANGING A DOCTOR BLADE IN A ROTARY PRINTING PRESS

FIELD OF THE INVENTION

The invention relates generally to printing presses and more particularly to a method and apparatus for replacing a doctor blade in a chamber-type doctor blade apparatus servicing a printing press while the printing press is running.

BACKGROUND OF THE INVENTION

Chamber-type doctor blade devices which are designed to supply printing fluids such as inks and varnishes to the applicator roller of a printing machine are known in the art. For example, DE-A-1,761,439, DE-B-1,806,140 and EP 0,071,180 A1 all teach chamber-type doctor blade devices. These chamber-type doctor blade devices are typically mounted upon a carrier which enables them to be positioned in engagement with the applicator roller of a printing press. Generally, a chamber-type doctor blade apparatus includes a housing having side walls which are formed by sliding seals such as the apparatus described in the publication WO 89/07047. The housing of the chamber-type doctor blade apparatus combines with a working doctor blade which is assigned to the applicator roller over a predetermined length to form a chamber for receiving the printing fluids from a supply line. The housing and the working doctor blade form an open channel or face adjacent the applicator roller which permits the fluids received through the supply line to flow to the applicator roller.

As taught by DE-B-1,806,140, the end of the chamber opposite the working doctor blade can be open, or, as illustrated in DE-A-1,761,439 and EP 0,071,180 A1, the chamber can be provided with a closing doctor blade which seals the open end of the chamber and combines with the working doctor blade and housing to form a closed chamber. When a closed chamber construction is employed, the working doctor blade and the closing doctor blade are brought into engagement with the applicator roller and, together with the side walls, provide a sealed enclosure which ensures the printing fluids can only exit the chamber through the open channel adjacent the applicator roller. Regardless of the type of chamber employed (i.e. open-ended or closed), the doctor blades (also simply called blades) are generally fastened to the housing by screw connections.

As mentioned above, chamber-type doctor blade devices of many different constructions are known in the art. For example, DE 3,838,546 C2 illustrates a chamber-type doctor blade apparatus having laterally non-displaceable doctor blades which can be placed loosely in a slot; DE 3,832,216 C1 illustrates doctor blades which are non-detachably arranged in a housing body; DE 3,909,879 C1 illustrates an integral chamber-type doctor blade apparatus (housing and doctor blade elements) arranged detachably on a carrier by means of a plug-in connection; and, DE 3,823,340 C1 illustrated a chamber-type doctor blade apparatus which receives at least one additional doctor blade inside the chamber. The additional blade taught by DE 3,823,340 C1 is intended to provide better wettability of the cells on the applicator roller to prevent so-called "ghosting".

Prior art chamber-type doctor blade devices suffer from many disadvantages. For instance, it is very expensive to replace a worn doctor blade in these printing machines because, in order to remove a doctor blade, the printing machine must be stopped. For example, in order to replace a worn working doctor blade, printing has to be interrupted and the chamber-type doctor blade apparatus has to be pivoted away or uncoupled from the applicator roller. Usually, the housing of the chamber-type doctor blade must be emptied to perform this procedure.

OBJECTS OF THE INVENTION

It is, therefore, a general object of the invention to provide an improved chamber-type doctor blade apparatus for use with printing machines. More specifically, it is an object of the invention to provide an improved chamber-type doctor blade apparatus having at least on doctor blade which can be removed and replaced while the printing machine is running. It is a related object to provide a chamber-type doctor blade apparatus that increases the efficiency of a serviced printing press by enabling the maintenance and replacement of worn doctor blades without stopping the serviced printing machine.

It is another object of the invention to provide a chamber-type doctor blade apparatus having a housing which does not need to be completely demounted when the doctor blades are serviced. It is a related object to provide a chamber-type doctor blade apparatus whose doctor blades can be serviced without draining the printing fluids from the chamber.

SUMMARY OF THE INVENTION

The present invention accomplishes these objectives and overcomes the drawbacks of the prior art by providing a chamber-type doctor blade apparatus which has an elongated housing including side walls defining a chamber. The chamber has an open face disposed adjacent and parallel to the applicator roller of the printing press for transferring fluids thereto. The housing defines an elongated opening communicating with the chamber which is disposed substantially parallel to the axis of the applicator roller. The apparatus also includes a sealing doctor blade which is mounted in the housing adjacent the opening and disposed for engagement with the applicator roller to prevent fluid flow between the chamber and the opening. The sealing doctor blade is normally biased toward engagement with the applicator roller. The chamber-type doctor blade apparatus further includes a receiver removably disposed within the elongated opening of the housing. The receiver includes a replaceable doctor blade which is adjustably mounted for operative engagement with the applicator roller. Finally, the apparatus includes means on the receiver for engaging the sealing doctor blade when the receiver is disposed in the opening to pivot the sealing doctor blade against the normal bias and out of engagement with the applicator roller. The sealing doctor blade is operative under the normal bias for pivoting into engagement with the applicator roller thereby preventing fluid flow out of the chamber when the receiver is removed from the elongated opening in the chamber housing.

These and other features and advantages of the invention will be more readily apparent upon reading the following description of the preferred embodiment of the invention and upon reference to the accompanying drawings wherein:

DESCRIPTION OF A PREFERRED EMBODIMENT

Figure 1:
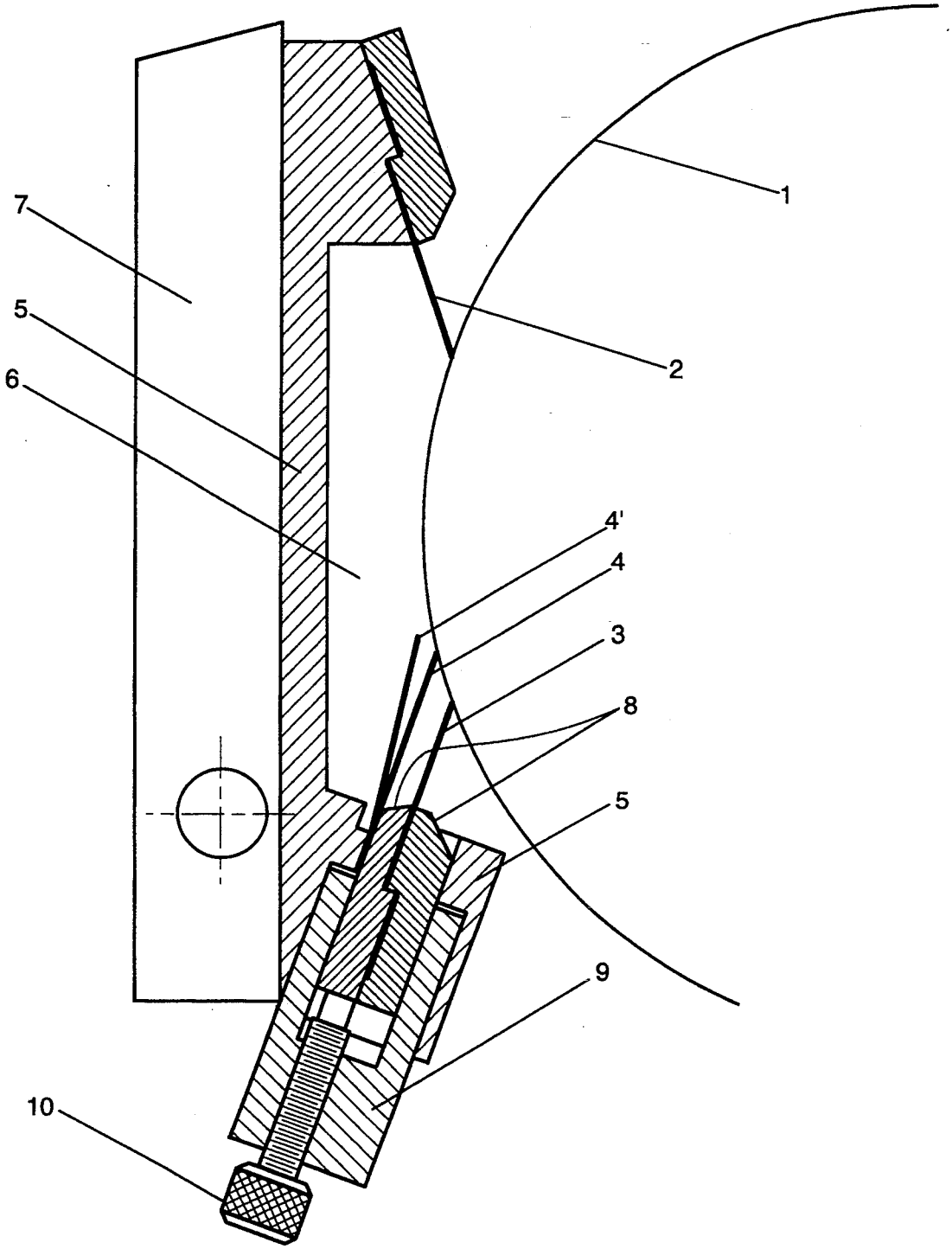
FIG. 1 is a sectional side view of a chamber-type doctor blade apparatus constructed in accordance with the teachings of the present invention.

Turning now to the drawings, FIG. 1 illustrates a chamber-type doctor blade apparatus constructed in accordance with the teachings of the present invention. FIG. 1 illustrates the chamber-type doctor blade apparatus in conjunction with a varnishing unit of an offset rotary printing press. It will be appreciated, however, that the chamber-type doctor blade apparatus is shown only as an example of an environment in which the invention may be used. In its broader aspects, the invention is not limited to use in any specific type of printing press or setting. Rather, the invention may be utilized in any apparatus which would benefit as a result of its performance characteristics. In view of these widespread uses, nothing in this application is meant to restrict the number or type of applications in which the invention may be used.

As mentioned above, the chamber-type doctor blade apparatus illustrated in FIG. 1 can be used in a varnishing unit of an offset rotary printing machine designed in series construction. Both the varnishing unit, which applies water-dilutable, pigmented liquids of relatively high viscosity to the printing carrier, and the printing press can have any of a number of constructions which are well known in the art. However, the printing machine is generally provided with an applicator roller 1 having a structured surface which includes a plurality of cells. This applicator roller 1, which is positioned for rotation about its longitudinal axis, acts as a varnishing roller when the chamber-type doctor blade apparatus is being used in a varnishing unit. Thus, the applicator roller 1, which is disposed in contact with a form cylinder (not shown) of the printing machine, transfers printing fluids such as varnish from the cells of the applicator roller 1 to the form cylinder.

The chamber-type doctor blade apparatus is fastened on a carrier 7 and assigned to the applicator roller 1 so that it can be set against the latter. The chamber-type doctor blade apparatus preferably consists of an elongated housing 5, a receiver 9 carrying a working doctor blade 3 which is set at a negative angle to the direction of rotation of the applicator roller 1, a closing doctor blade 2 which is set at a positive angle in the direction of rotation of the applicator roller 1, and side walls 12 for the purpose of forming a chamber 6. The chamber 6, which is coupled to a printing fluid supply (not shown) via an inlet and an outlet for receiving printing fluids such as varnish or inks, includes an open face or channel disposed adjacent and parallel to the applicator roller 1 for transferring fluids thereto. As explained below, the housing 5 is also provided with at least one elongated opening which communicates with the chamber 6. This elongated opening is disposed substantially parallel to the longitudinal axis of the applicator roller 1.

As illustrated in FIG. 1, the sealing doctor blade 4 is pivotably fastened in the housing 5 adjacent the elongated opening at a negative angle to the direction of rotation of the applicator roller 1. Preferably, the sealing doctor blade 4 is detachable from the housing 5. In any event, the sealing doctor blade 4 is disposed between the chamber 6 and the elongated opening of the housing 5. Thus, the sealing doctor blade 4 combines with the elongated housing 5 and the side walls 12 to seal the chamber 6 and prevent the printing fluids from flowing out of the chamber 6 into the elongated opening of the housing. Specifically, the sealing doctor blade 4 is pivotable between a first position in which the sealing doctor blade 4 contacts the applicator roller 1, and a second position (illustrated at 4' in FIG. 1) in which the sealing doctor blade 4 and the applicator roller 1 are separated. The sealing doctor blade 4 is normally biased into engagement with the applicator roller 1. It will, therefore, be appreciated by those skilled in the art that, absent a countervailing force, the sealing doctor blade 4 will pivot into contact with the applicator roller 1 thereby preventing fluids from flowing out of the chamber 6.

Figure 2:
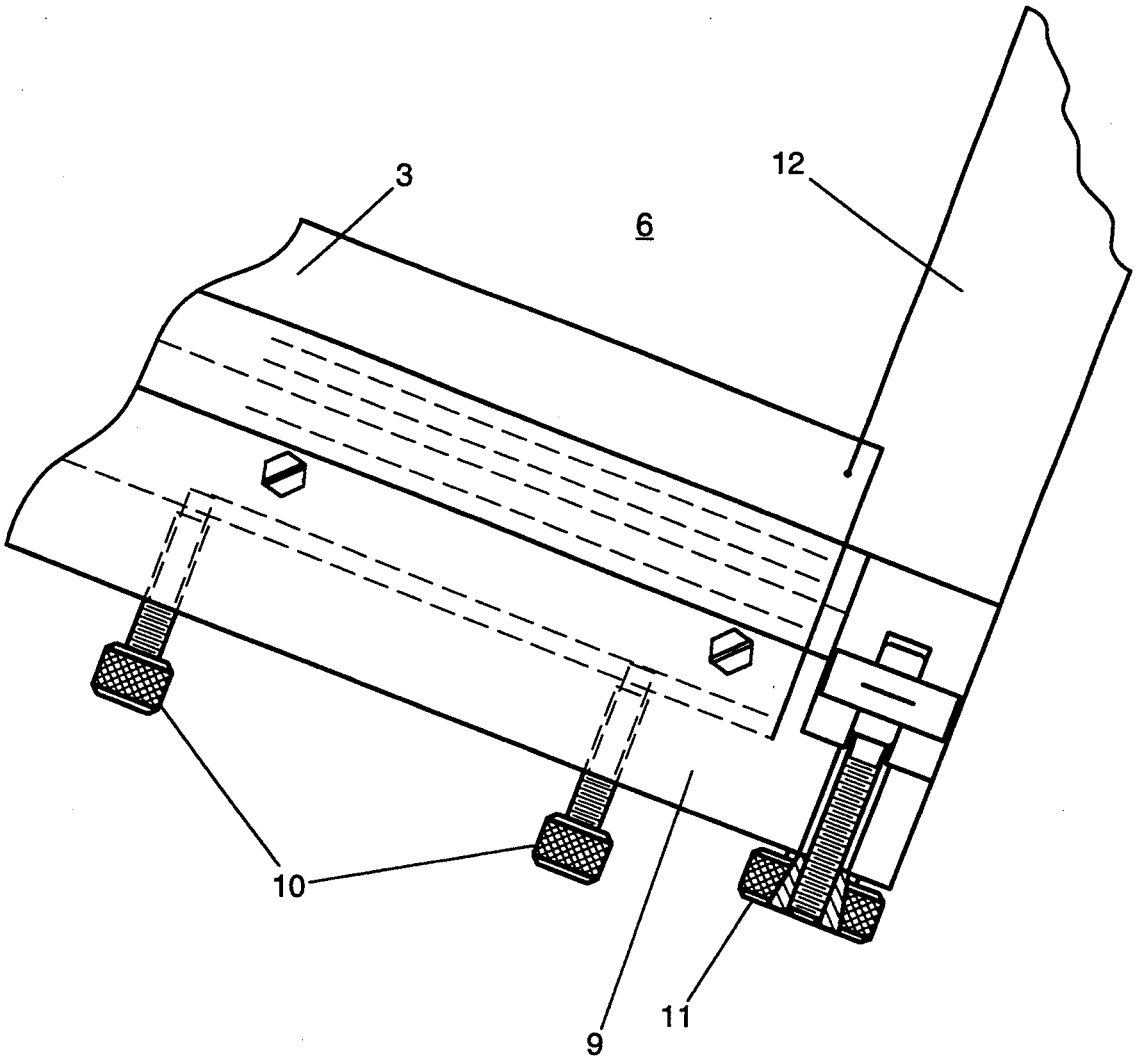
FIG. 2 is a front view of a working doctor blade connected to the receiver of the chamber-type doctor blade apparatus of FIG. 1.

As shown in FIG. 1, the chamber-type doctor blade apparatus is further provided with a receiver 9 which is removably disposed in the elongated opening defined by the housing 5. The receiver 9 is preferably arranged in a sealed manner at the free ends of the housing 5 so as to be detachable by means of two quick-acting closures 11 as shown in FIG. 2. Although a snap-on connection or a bayonet connection is preferably used as the quick-acting closures 11, it will be appreciated that other quick-acting closures could likewise be employed without departing from the scope or spirit of the invention. In any event, the receiver 9 includes a clamping rail 8 which receives and detachably holds a replaceable working doctor blade 3 as illustrated in FIG. 1. When the receiver 9 is positioned within the elongated opening of the housing 5, the working doctor blade 3 engages the applicator roller 1 to prevent flow therebetween. To this end, the receiver 9 is provided with adjusting elements 10 distributed over its length for adjusting the position of the doctor blade 3 to ensure that the working doctor blade 3 is properly positioned relative to the applicator roller 1. As illustrated in FIG. 2, these adjusting elements 10 preferably comprise three adjusting screws. However, it will be appreciated that other adjustable fasteners might also be used without departing from the invention. It will further be appreciated that the working doctor blade 3, the clamping rails 8, the adjusting elements 10 and the receiver 9 combine to form a functional module which can be withdrawn and inserted into the elongated opening of the housing as a unit. This, of course, greatly facilitates replacement of the working doctor blade 3.

As illustrated in FIG. 1, the receiver 9 includes a slidable cam surface for engaging the sealing doctor blade 4 when the receiver 9 is positioned in the elongated opening of the housing 5. This slidable cam surface urges the sealing doctor blade 4 against its normal bias thereby pivoting the sealing doctor blade 4 away from the applicator roller 1 to the position illustrated at 4'. It will, thus, be appreciated by those skilled in the art that the insertion of the receiver 9 into the elongated opening of the housing 5 both brings the working doctor blade 3 into engagement with the applicator roller 1 and pivots the sealing doctor blade 4 out of engagement with the roller 1. Similarly, when the receiver 9 is removed from the elongated opening, the sealing doctor blade 4 pivots back into engagement with the applicator roller 4 under the force of its normal bias and the working doctor blade separates from the roller 1 as the receiver 9 is withdrawn.

The inventive chamber-type doctor blade apparatus thus permits a user to replace the working doctor blade 3 while a printing press or machine serviced by the apparatus is running in the non-printing position. For example, if a user wishes to replace a worn working doctor blade 3, the user need only loosen the quick-acting closure 11 and slide the receiver 9 out of the elongated opening. The removal of the receiver 9 will then permit the sealing doctor blade 4 to pivot under the force of its normal bias into engagement with the applicator roller 1. As a result, the elongated opening will be isolated from the chamber 6, and only a small amount of printing fluid, if any, will flow from the chamber 6 during this withdrawal. Consequently, the printing machine can continue running.

The user can then remove the worn doctor blade 3 from the receiver 9 by loosening the adjusting elements such that the clamping rail 8 opens. A fresh doctor blade 3 can be positioned in the clamping rail 8 and, after the new doctor blade's position is satisfactorily adjusted and secured in the clamping rail 8, the receiver 9 can be reinserted into the elongated opening. During reinsertion, the working doctor blade 3 slides in a sealing manner along the sealing doctor blade 4 until the working doctor blade 3 rests against the applicator roller 1. In this case, the contours of the working doctor blade 3 and the sealing doctor blade 4 form a slider cam mechanism. The working doctor blade 3 acts as the slider member and the sealing doctor blade 4 as the lifting member. When the functional module formed by the receiver 9 and the components it carries is introduced, the working doctor blade 3 moves the sealing doctor blade 4 inside the chamber 6 in a direction away from the applicator roller 1 so that the sealing doctor blade 4 assumes the position 4'. The receiver 9 can then be connected to the housing 5 with the quick-acting closures 11. It should be noted that the quick-acting closures 11 serve only to connect the receiver 9 to the housing 5 since the position of the working doctor blade 3 is separately adjusted by means of the adjusting screws 10.

Although the chamber-type doctor blade apparatus has been described as including a housing 5 having an elongated opening for receiving a receiver 9 carrying a working doctor blade 3, it will be appreciated by those skilled in the art that the housing 5 can be equipped to receive a second receiver carrying a closing doctor blade 2 instead of, or in addition to, the receiver 9 carrying the working doctor blade 3 described above without departing from the scope or the spirit of the invention. It will further be appreciated that, should this second receiver be employed, the closing doctor blade 2 will be assigned a sealing doctor blade 4 which will be pivotably mounted above the chamber 6 and below a second elongated opening formed in the housing for receiving the second receiver. In this instance, the sealing doctor blade 4 will be positioned at a positive angle to the direction of rotation of the applicator roller 1. Thus, it will be appreciated that the chamber-type doctor blade apparatus can be provided with a single elongated opening and a single receiver positioned to carry a working doctor blade 3; a single elongated opening and a single receiver positioned to carry a closing doctor blade 2; or two elongated openings and two receivers, one carrying a working doctor blade 3 and the other carrying a closing doctor blade 2, without departing from the invention.

In view of the foregoing, it will be appreciated by those skilled in the art that the invention enables the rapid exchange and replacement of doctor blades servicing a running printing press. Specifically, the doctor blades can be exchanged while the machine is running in the non-printing position because the sealing doctor blade will prevent the printing fluids from flowing out of the chamber when the receiver is removed from the housing. As a result, the housing does not need to be completely demounted and the printing fluids do not have to be drained from the chamber to perform the exchange. Set-up and servicing times are appreciably reduced because worn doctor blades can be exchanged or preassembled and adjusted outside the printing operation. For example, the precise position of the doctor blade can be adjusted with a gauge or the like while the receiver 9 is withdrawn from the housing 5. A doctor blade which is pre-adjusted in this manner need only be coupled to the chamber housing for the chamber-type doctor blade apparatus to be ready for operation.

It should be noted that depending on the respective contact angle of the doctor blade to be changed, (the invention is suitable for doctor blades at a negative or positive contact angle), the sealing doctor blade used is always arranged between the actual chamber and the respective doctor blade. It should further be noted that in addition to the preferred closed chamber embodiment (i.e., the embodiment employing both a working doctor blade 3 and a closing doctor blade 2), the invention can also eliminate the closing doctor blade 2 and operate with one side of the chamber 6 open.

Finally, it should also be noted that, for particular applications, the sealing doctor blade 4 can also be omitted and the doctor blades in the chamber-type doctor blade apparatus can be replaced by removing the receiver 9 in the manner described above. Depending on the application (working or closing doctor blade exchange), the chamber 6 then has to be emptied of printing fluids before performing the exchange.

I claim:

1. A chamber-type doctor blade apparatus for use in a printing press with an applicator roller having a longitudinal axis, the chamber-type doctor blade apparatus comprising, in combination:

an elongated housing including side walls defining a chamber, the chamber having an open face disposed adjacent and parallel to the applicator roller of the printing press for transferring fluids thereto, the housing defining an elongated opening communicating with the chamber and disposed substantially parallel to the axis of the applicator roller;

a sealing doctor blade mounted in the housing adjacent the opening and disposed for engagement with the applicator roller to prevent fluid flow between the chamber and the opening, the sealing doctor blade being normally biased toward engagement with the applicator roller;

a receiver removably disposed within the elongated opening of the housing and including a replaceable doctor blade adjustably mounted for operative engagement with the applicator roller, and means on the receiver for engaging the sealing doctor blade when the receiver is disposed in the opening to pivot the sealing doctor blade against the normal bias and out of engagement with the applicator roller, the sealing doctor blade being operative under the normal bias for pivoting into engagement with the applicator roller thereby preventing fluid flow out of the chamber when the receiver is removed from the opening in the chamber housing.

2. A chamber-type doctor blade apparatus as defined in claim 1 including quick-acting closure means for securing the receiver to the chamber housing.

3. A chamber-type doctor blade apparatus as defined in claim 1 including a clamping rail for securing the replaceable doctor blade to the receiver.

4. A chamber-type doctor blade apparatus as defined in claim 3 including a plurality of adjusting screws mounted in the receiver for adjustably positioning the replaceable doctor blade relative to the chamber housing.

5. A chamber-type doctor blade apparatus as defined in claim 1 wherein the replaceable doctor blade is a working doctor blade disposed at a negative angle with respect to the direction of rotation of the applicator roller.

6. A chamber-type doctor blade apparatus as defined in claim 5 wherein the sealing doctor blade is disposed above the elongated opening and the working doctor blade and is angled upwards towards the chamber and the applicator roller.

7. A chamber-type doctor blade apparatus as defined in claim 1 wherein the replaceable doctor blade is a closing doctor blade disposed at a positive angle with respect to the direction of rotation of the applicator roller.

8. A chamber-type doctor blade apparatus as defined in claim 7 wherein the sealing doctor blade is disposed below the elongated opening and the closing doctor blade and is angled downwards towards the chamber and the applicator roller.

9. A chamber-type doctor blade apparatus as defined in claim 1 wherein the means on the receiver for engaging the sealing doctor blade includes a slidable cam surface for urging the sealing doctor blade against the normal bias thereof.

* * * * *